United States Patent [19]

Jacobs et al.

[11] Patent Number: 4,819,297

[45] Date of Patent: Apr. 11, 1989

[54] SLIDING DOOR TOP GUIDE OR HANGER

[75] Inventors: Kenneth Jacobs, Esher, England; Torsti T. T. Jerila, West Covina, Calif.

[73] Assignee: Acme General Corportion, San Dimas, Calif.

[21] Appl. No.: 43,496

[22] Filed: Apr. 28, 1987

[51] Int. Cl.[4] ..... E05D 15/06

[52] U.S. Cl. ..... 16/87 R; 16/93 R; 160/196.1; 49/409

[58] Field of Search ..... 16/87.2, 87.4 R, 87.4 W, 16/87.6 R, 87.6 W, 90, 93 R, 93 D, 87 B, 87 R; 49/409, 410; 160/196 R, 200, 113; 104/134

[56] References Cited

U.S. PATENT DOCUMENTS

| | | | |
|---|---|---|---|
| 995,787 | 6/1911 | Hill | 49/409 |
| 2,897,515 | 8/1959 | Collins | 160/196.1 |
| 3,750,337 | 8/1973 | Brydolf et al. | 16/90 |
| 4,124,918 | 11/1978 | Cummings | 16/940 |
| 4,258,443 | 3/1981 | Baus | 16/93 R |

*Primary Examiner*—Nicholas P. Godici
*Assistant Examiner*—Edward A. Brown
*Attorney, Agent, or Firm*—Christie, Parker & Hale

[57] ABSTRACT

An integral plastics body mounted on a corner connector for a door can serve as either a hanger or guide. As a hanger, the assembly supports the weight of a door for sliding along a horizontal overhead track having a downwardly extending L-shaped limb. If used as a guide with such a track, the plastics body can move vertically relative to the corner connector. Rigid posts extend upwardly from the body for encompassing opposite sides of the foot of the L-shaped limb on the track. A flexible finger extending upwardly from the body has a hook that fits over the top of the foot on the L-shaped limb for safely latching the plastics body to the track, thereby preventing toppling of the door. A tab on the finger permits it to be manually flexed to withdraw the hook from over the foot and release the plastics body from the track.

37 Claims, 3 Drawing Sheets

SLIDING DOOR TOP GUIDE OR HANGER

BACKGROUND OF THE INVENTION

This invention concerns a guide or hanger for retaining the top of a sliding door in engagement with a horizontal overhead track. For a relatively lightweight door the invention may be used as a hanger for supporting the weight of the door. For a relatively heavier door, the invention may be used as a guide with the weight of the door supported by wheels at the bottom.

It is now commonplace to employ what are known in the industry as bypass doors on closets, wardrobes, and the like. These are often known in the vernacular as sliding doors, even though the supporting mechanism most often employs wheels. In a typical installation, there are a pair of horizontal tracks along the floor and another pair of tracks on the lintel. A pair of doors ride in the upper and lower pairs of tracks with each door passing in front of or behind the other door. Collectively, the two doors close the opening and they may be opened from either jamb. To close wide openings, three or more such doors may be mounted in the tracks.

A relatively common mounting arrangement has a wheel or wheels at each upper corner of a door. There is an upper horizontal track with a downwardly extending J-shaped leg. The wheels roll in the J-shaped foot of the track to support the weight of the door. A vertical height adjustment is commonly incorporated in the connection between the wheels and door. A simple guide at each lower corner of the door slides in a bottom track. Another type of hanger has a rectangular plastic slider that rides in the J-shaped track.

Another type of installation more commonly used on heavier doors, has wheels at each lower corner of the door to ride in or on the lower track. Vertical height adjustment is provided in the connection between the wheels and door. A guide at each upper corner of the door fits into an upper track. In such an embodiment it is not usually necessary to use a J-shaped leg on the track and the upper track may simply have a downwardly-opening U-shaped channel in which the guide travels. If a J-shaped track is used, a slider may be spring biased down into the foot of the track to guide the top of the door.

A concern in sliding or bypass doors is the possibility that the door will be dislodged from the track under abuse. This can cause the door to drop a sufficient distance so that it no longer engages the top track and can topple. This is of particular concern in heavy mirrored doors because of the possibility of injury. It is a possibility aggravated when the bottom track is elevated relative to the adjacent floor. This occurs, for example, in wardrobes or closets where the floor is somewhat above the floor of the adjacent room. It is therefore desirable to provide a top hanger or guide which securely engages the top track and prevents toppling of a door even if it is dislodged from the bottom track. It is desirable that similar structure be employed for either a hanger or guide for minimizing the number of parts to be made. It is desirable that the hanger or guide engage the top track easily for facilitating installation. It is desirable that the hanger or guide be easily released from the track if desired, preferably without use of special tools.

BRIEF SUMMARY OF THE INVENTION

Thus, there is provided in practice of this invention according to a presently preferred embodiment, a hanger or guide for engaging a horizontal overhead track having a generally L-shaped or J-shaped downwardly extending limb. The hanger or guide has a body and means for connecting the body to the top of a door. Rigid means are provided on the body for engaging the track on at least the face opposite the foot of the L. The body also supports elastically flexible means for fitting over the top of the foot of the L-shaped track in an unflexed position nearer the rigid means, and for clearing the foot of the L-shaped track in a flexed position further from the rigid means.

BRIEF DESCRIPTION OF THE DRAWINGS

These and other features and advantages of the present invention will be appreciated as the same becomes better understood by reference to the following detailed description when considered in connection with the accompanying drawings wherein:

FIG. 1 illustrates the face of a hanger constructed according to principles of this invention, viewed from the inside of a door and including a fragment of the door, a plastics body for engaging an overhead track, and means for connecting the body to the door;

DETAILED DESCRIPTION

Figure 2:
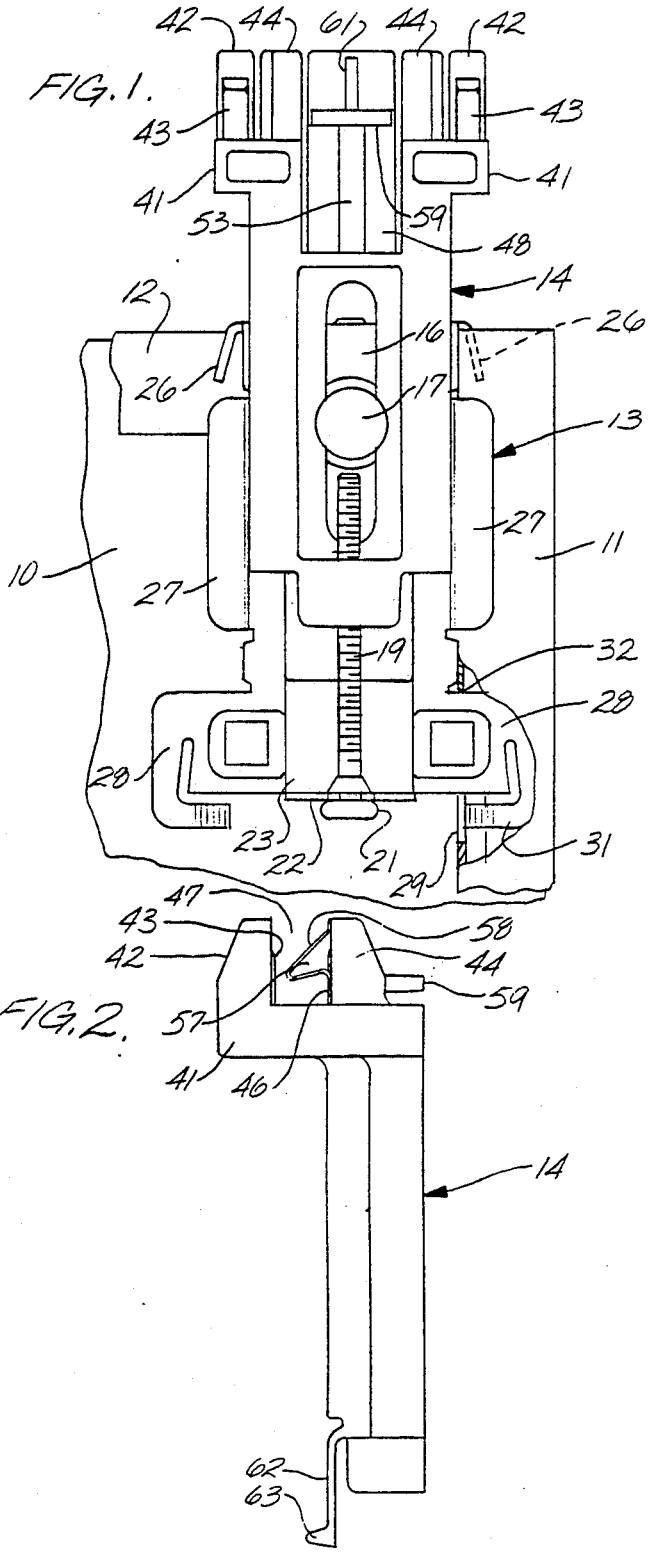
FIG. 2 is a side view of the plastics body.

An exemplary bypass or sliding door comprises a flat panel 10 such as plywood or mirrored glass, the rear or inside face of which is illustrated in FIG. 1. Along each side edge of the panel there is a sheet metal stile 11, which is conveniently fabricated by roll forming. In the exemplary embodiment the stile has a generally G-shaped cross-section which grips an edge of the flat panel.

Along the top and bottom edges of the door panel there is a roll formed sheet metal rail 12 which is essentially a U-shaped member fitted over the edge of the panel and sufficiently springy to frictionally engage it. A corner connector 13 attaches to the rail and stile for securing them together at the corner of the door. A similar corner connector is used in each corner of the door for securing the stiles and rails on the door panel.

A prior sliding door corner connector is described and illustrated in U.S. Pat. No. 3,750,337 (Australia Pat. No. 476,589; Canadian Pat. No. 978,805; United Kingdom Pat. No. 1,430,862). In that patent there is described a steel member for interconnecting the stile and rail of a panel door. The same steel member is employed as a corner connector in a preferred embodiment of this invention and the description of the aforementioned U.S. patent is hereby incorporated by reference.

Centrally located on the plane of symmetry of the corner connector is a shallow U-shaped channel 23 for receiving a door suspension member. An exemplary suspension member in the form of a hanger with a wheel at one end is described and illustrated in the aforementioned patent. A variety of hangers and guides have been fitted on various commercial embodiments of such a corner connector. A plastics hanger or guide body 14 constructed according to principles of this invention is illustrated on such a corner connector in FIG. 1.

A longitudinal guide slot 16 extends along the body which is secured to the connector 13 by a rivet 17 extending through the guide slot. The length of the rivet is sufficient that it does not so tightly grip the plastics body as to prevent longitudinal movement of the body along the slot. A longitudinal screw hole 18 (FIG. 3) extends through the body at one end of the guide slot. A self-tapping adjustment bolt 19 is threaded through the hole 18. The double head 21 of the adjustment bolt fits into a bolt retainer slot in a bolt retainer tongue 22 that extends normal to the principal extent of the central U-shaped channel 23 along the corner connector. The relative positions of the hanger and connector are adjusted by turning the bolt 19, which permits adjustment of the door to the frame and overhead track after it is hung. The corner connector and its attachment and adjustment features are conventional and for clarity are deleted from the views of FIGS. 2 to 5.

The embodiment illustrated in FIG. 1 is for use when the plastics body is employed as a hanger for supporting the weight of a door. In a guide embodiment, the adjustment bolt is omitted. This leaves the plastics body free to slide vertically on the rivet and accommodate differences in spacing between the top of the door and the track.

Briefly, the corner connector has a pair of ears 26 lying in planes transverse to the principal extent of the connector, that is, transverse to the plane of the door panel 10. One of the ears 26 fits into the open top of the stile and engages the inside of its back wall as well as an internal wall within the stile. On each side of the corner connector a wing 27 extends laterally in a plane parallel to the panel. One of the wings overlies the back wall of the stile.

At the opposite end of the connector from the ears 26 are a pair of laterally extending tangs 28, one of which fits through a slot 29 so that a principal portion of the tang is within the stile. A spring arm 31 on the tang secures the tang in the slot. When the corner connector is used with a door hanger (as in FIG. 1), the weight of the door is transmitted by means of the stile to the tang at a load bearing point 32 and thence via the adjustment bolt to the hanger.

Figure 3:
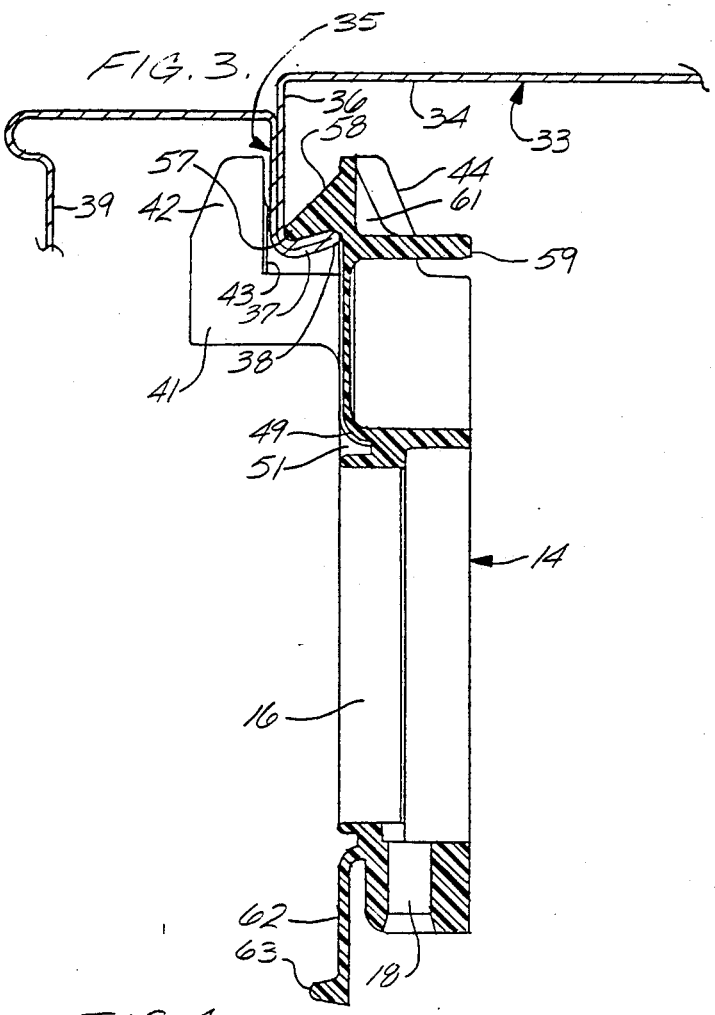
FIG. 3 is a longitudinal cross-section of the body engaging an overhead track.
Figure 4:
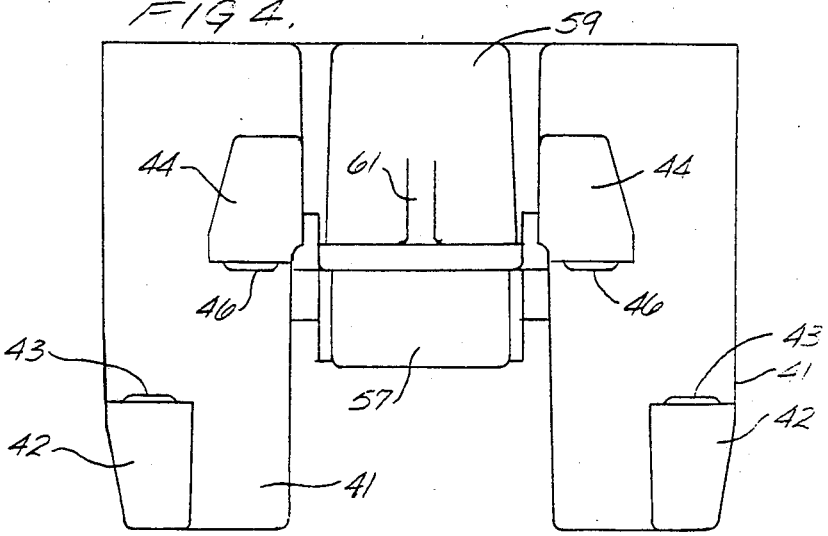
FIG. 4 is a top view of the body.

The hanger is used with a horizontally extending overhead track 33, a portion of which is illustrated in cross-section in FIG. 3. Such a track has a flange 34 which is secured to a door lintel by screws (not shown). A downwardly-extending limb 35 is generally L-shaped with a vertical leg 36 and a generally horizontally extending foot 37. Preferably the foot is angled so that its toe 38 is elevated relative to the connection to the leg 36 which, as will become apparent, helps assure that the hanger will remain e with the foot on the track. On one embodiment of the conventional track, the L-shaped limb has a deeply curved foot so that it is essentially a J-shape in transverse cross-section. The hanger or guide works well with either embodiment.

An exemplary track has a second downwardly extending limb (not shown) for hanging a second door which can bypass the door hung on the illustrated limb. A decorative fascia 39 is provided at the front of the track for obscuring the top edge of the door and the portion of the corner connector that might otherwise be seen extending above the top edge of the door. Such a track is readily roll formed from prepainted steel. An extruded aluminum track may be used, if desired.

A pair of arms 41 extend forwardly from the body near the top. These arms extend over the rail at the top of the door to approximately the plane of the front face of the door. A rigid front post 42 extends upwardly from the front end of each of the arms. A raised pad 43 on each front post provides an area for the post to engage the front face of the limb on the track, that is, the face opposite the foot on the L-shaped cross-section of the downwardly extending limb.

A pair of spaced-apart rigid back posts 44 extend upwardly as an extension of the body to approximately the same height as the front posts 42. Each of the back posts has a slightly raised pad 46 which may engage the toe of the downwardly extending limb of the track. The space 47 (FIG. 2) between the pads on the front and back posts is slightly larger than the width of the foot 37 (FIG. 3) on the track so that as the hanger or guide slides along the length of the track, there is no binding. The space between the front and back pads is preferrably not a lot larger than the length of the foot so that rattling of the door is minimized.

A finger 48 integral with the body extends upwardly between the back posts 44. Throughout most of its length the finger is vertical and near its lower end it curves rearwardly. The resultant curved portion 49 connects to the body above a reentrant transverse trench 51.

Figure 5:
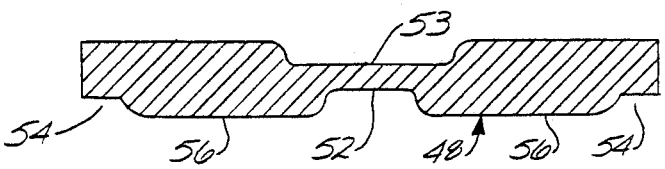
FIG. 5 is a transverse cross-section of a flexible finger on the hanger or guide.

In transverse or horizontal cross-section the finger has central longitudinal grooves 52 and 53 (FIG. 5). The longitudinal groove 52 on the front of the finger and a shallow relief 54 along each edge of the finger define the edges of what amounts to a pair of raised pads 56, the faces of which may on occasion contact the toe 38 of the track. The longitudinal grooves 52 and 53, and the curved portion 49 at the bottom of the finger provide it with sufficient elastic flexibility to be bent by hand in the backward direction away from the track.

A forwardly extending hook 57 at the top of the finger extends into the space 47 between the front and back posts. The bottom of the hook preferably extends somewhat downwardly towards its tip so as to positively engage the toe on the track and avoid accidental deflection. The top of the hook has a sloping ramp 58 extending upwardly from the tip. A tab 59 extends rearwardly from the finger near its upper end, that is, it is on the opposite side of the finger from the hook 57. A small reinforcing rib 61 stiffens the connection between the tab and finger.

A tail 62 extends downwardly from a lower portion of the body and terminates in a transverse ridge 63. The ridge extends forwardly, i.e., toward the door panel, further than the forward face of the principal portion of the body. Thus, when the body is secured to the corner connector by the rivet, the raised ridge causes deflection of the tail 62, which thereby acts like a spring to bias the body relative to the corner connector and minimize the possibility of rattling.

When the hanger is used, a door with such a hanger in each top corner is pushed upwardly with the downwardly extending limb 35 of the overhead track in the space 47 between the front and back posts. The toe 38 of the L-shaped limb engages the ramp 58 on the bottom of the hook 57. The resultant rearward force on the hook bends the finger 48 rearwardly so that the hook effectively rotates away from the track, primarily around the lower curved portion 49 of the finger, but also by deflection of the vertical portion of the finger.

This elastic deflection of the finger permits the track to pass the hook on the end of the finger, and after this has occurred the finger snaps back into its unflexed position with the hook overlying the foot of the L-shaped limb on the track. When the door is released, the weight of the door is thus carried from the body to the track by way of the finger and hook. Once the door is thus hanging from the track, the adjustment bolt 19 can be rotated to cause relative movement between the corner connector and plastics body for adjusting the door height.

In the event it is desired to remove the hanger from the track, downward pressure on the tab 59 flexes the finger rearwardly, effectively rotating the hook away from the track so as to clear the foot of the track and permit removing of the door. The grooves in the finger and the curved portion at its connection to the body make it sufficiently flexible that it can be easily flexed with a person's finger tip, while still being strong enough to support the weight of a door.

It has been found that it is not necessary to employ wheels at the top of doors light enough to be carried by the fingers on the hangers described. The body of the hanger is an injection molded plastic material such as an acetal. It is found that such material forming the hook has low friction with prepainted steel and such a door can be opened or closed with about the same force as used for a door hung on wheels. Further, there is an advantage to this way of hanging a door since the sliding of the plastics body on the prepainted steel is considerably less noisy than the rolling of the wheel in an overhead track. The track may also be made of galvanized steel or extruded aluminum.

When the structure is used as a guide instead of a hanger, the adjusting bolt is deleted and the plastics body is free to move up and down on the rivet with no appreciable restraint. In previous guides spring loading has been used to assure that the guide remains in engagement with the track. This extra part is avoided with this construction since the hook and top of the arms encompass the track.

With the previous top guide for an L-shaped track, it was necessary to lift the entire door to obtain engagement. With the guide hereinabove described, the door can be positioned beneath the track and only the plastics body need be pushed up to deflect the finger and engage the hook with the track. Similarly, for removal the finger can be easily deflected by hand to disengage the hook from the track and permit lowering of the plastic body.

In addition to the ease of removal, a significant safety advantage is obtained with the hanger or guide as hereinabove described. The front and back posts on the body straddle the front and back of the track. The hook in its unflexed position extends into the space between the front and back posts for engaging the foot on the track. Because of the upstanding posts it is virtually impossible to accidentally deflect the finger and disengage the hanger or guide from the track. As a consequence, the top of the door is safely latched in place to prevent the door from toppling. Despite the secure latching of the hanger or guide, it is easily released by hand.

In addition to the safety and ease of installation and removal, there are significant manufacturing benefits. When used as a hanger, only four parts are required to make the assembly, namely, the corner connector, rivet, adjusting bolt, and plastics body. The hanger replaced has at least six parts and in one embodiment has ten parts. The savings are at least as impressive when used as a guide, where only three parts are required. The guide replaced has eight parts. In addition, the guides and hangers replaced do not have the safety feature of latching to the track, as provided in the practice of this invention.

An additional advantage is that the same top track may be used whether the invention is used as a hanger or guide. This means that a track can be installed for a lightweight door employing a hanger. If it should later be decided to employ a heavy mirrored door, it can be guided at the top using the same track.

Figure 6:
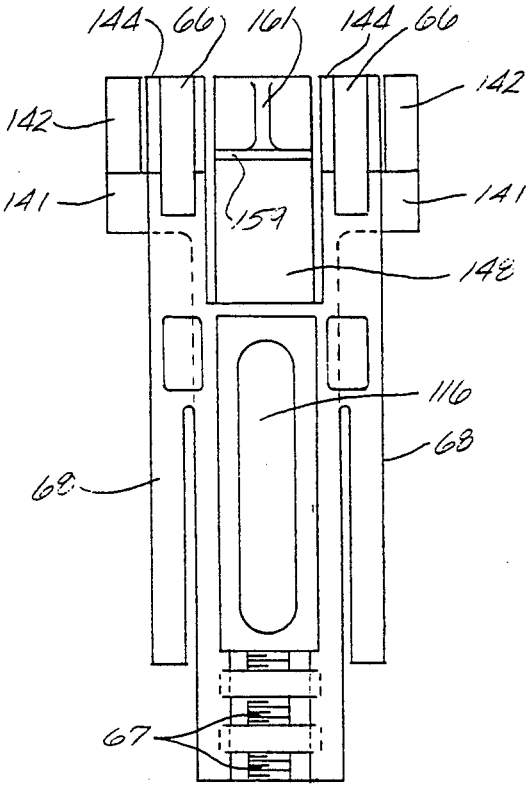
FIG. 6 is a view of one face of another embodiment of a plastic body.

FIG. 6 illustrates another embodiment of a plastics body useful in practice of this invention. Most of this body is identical to the embodiment hereinabove described and illustrated in FIGS. 1 to 5. Similar parts are indicated on the drawing of FIG. 6 with reference numerals 100 larger than the corresponding reference numerals in FIGS. 2 to 5. Thus, for example, the elastically flexible finger in FIG. 6 is designated by reference numeral 148, corresponding to reference numeral 48 in FIG. 1.

As illustrated in this embodiment, the body has a pair of arms 141 each of which supports a front post 142. Back posts 144 extend upwardly from the body about the same distance as the front post. The back posts and part of the body include cavities 66 which reduce the material cross-section for minimizing shrinkage deformities, as is conventional in injection molding practice. A flexible finger 148 extends upwardly from the body and includes a tab 159 reinforced by a rib 161 so that the finger can be deflected in the manner hereinabove described. This releases a hook (not shown in the back view of FIG. 6) to permit the body to be removed from an overhead track.

The body may be connected to a corner connector by a rivet (not shown) engaging the sides of a guide slot 116. An adjusting bolt (not shown) may engage a "half-hole" having preformed threads 67 formed in the half-hole. This is a conventional technique for injection molding where each half of the molding die has a plurality of generally V-shaped extensions, each with a thread form at its outer end. The alternating extensions form opposite sides of the threaded half-hole. In the drawing of FIG. 6 the threads due to three of such die extensions from the nearer side of the part can be seen. The threads from intervening extensions from the other die half are hidden. If desired, a similar injection molding technique can be used to form a "half hole" without preformed threads, and such a part can be used with a thread forming adjusting bolt.

A pair of elastic tongues 68 extend downwardly on each side of a mid-portion of the plastics body. These tongues engage lateral portions of the corner connector on which the body is mounted; such as for example, the wings 27 on the corner connector of FIG. 1. The elastic tongues press against the corner connector much in the same manner as the tail and ridge 62 and 63 in the first embodiment to prevent rattling of the assembly.

Although limited embodiments of the hanger or guide constructed according to principles of this invention have been described and illustrated herein, many other modifications and variations will be apparent to one skilled in this art. For example, a hole or transverse groove may be provided in the tab on the finger for engagement by a tool to facilitate flexing of the finger for removing the hanger or guide from a track. Some of the parts may be rearranged or modified to facilitate injection molding.

It will be apparent that the plastics body with flexible means for fitting over the top of the foot of the track may be used with corner connectors different from the type hereinabove described and illustrated. This is but one style of commercially available corner connector. It should also be noted that such a safety latching hanger or guide may be connected to the top of a solid door instead of one having metal stiles and rails and a door panel. In such an embodiment, the means for connecting the plastics body having the flexible finger and hook may be very different from the corner connector hereinabove described and illustrated.

It will therefore be understood that within the scope of the appended claims, the invention may practiced otherwise than is specifically described.

What is claimed is:

1. A sliding door hanger or guide for engaging a horizontal overhead track with a downwardly extending generally L-shaped limb comprising:

a body;

means for connecting the body to the top of a door;

rigid means on top of the body for engaging such a track on at least the face opposite the foot of the L; and elastically flexible means for fitting over the top of the foot of the L-shaped track in an unflexed position nearer the rigid means for supporting the weight of the door and for clearing the foot of the L-shaped track in a flexed position further from the rigid means.

2. A. sliding door hanger or guide as recited in claim 1 wherein the body, rigid means, and flexible means are integral molded plastics material.

3. A sliding door hanger or guide as recited in claim 1 wherein in the elastically flexible means comprises a finger extending upwardly from the body and including a hook at its upper end for sliding along the L-shaped track.

4. A sliding door hanger or guide as recited in claim 3 comprising means on the finger for manually flexing the finger.

5. A sliding door hanger or guide for engaging a horizontal overhead track with a downwardly extending generally L-shaped limb comprising:

a body;

means for connecting the body to the top of a door;

rigid means on top of the body for engaging such a track on at least the face opposite the foot of the L; and an elastically flexible finger for fitting over the top of the foot of the L-shaped track in an unflexed position nearer the rigid means and for clearing the foot of the L-shaped track in a flexed position further from the rigid means; and means on the finger for manually flexing the finger comprising a tab protruding rearwardly from the finger opposite the hook.

6. A sliding door hanger or guide as recited in claim 3 comprising rigid means on the body for engaging the foot on the L-shaped track.

7. A sliding door hanger or guide as recited in claim 1 comprising second rigid means on the body for engaging the foot of the L-shaped track when the track is in the space between the first and second rigid means, and wherein the elastically flexible means includes a portion in the space between the first and second rigid means when in its unflexed position.

8. A sliding door hanger or guide as recited in claim 1 comprising means for adjusting the relative vertical position of the body and the means for connecting the body to a door.

9. A sliding door hanger or guide as recited in claim 1 wherein the body fits on the back of the door with the rigid means extending over the top of the door.

10. A sliding door hanger or guide for engaging a horizontal overhead track with a downwardly extending generally L-shaped limb comprising:

a body;

means for rigidly connecting the body to the top of a door;

at least one upstanding post on the body for opposing one face of such an L-shaped limb;

a finger extending upwardly from the body;

a hook at the top of the finger extending laterally toward such a post for engaging the foot of the L-shaped limb; and means on the finger for rotating the top of the finger away from the direction of extension of the hook for disengaging the hook from such a limb.

11. A sliding door hanger or guide as recited in claim 10 wherein the finger is sufficiently elastically flexible between the hook and its connection to the body to permit such rotation.

12. A sliding door hanger or guide for engaging a horizontal overhead track with a downwardly extending generally L-shaped limb comprising:

a body;

means for connecting the body to the top of a door;

at least one upstanding post on the body for opposing one face of such an L-shaped limb;

a finger extending upwardly from the body;

a hook at the top of the finger extending laterally toward such a post for engaging the foot of the L-shaped limb; and a tab integral with the finger extending laterally on the opposite side from the hook for rotating the top of the finger away from the direction of extension of the hook for disengaging the hook from such a limb; and wherein the finger is sufficiently elastically flexible between the hook and its connection to the body to permit such rotation.

13. A sliding door hanger or guide as recited in claim 11 wherein in the body, rigid means and flexible means are integral molded plastics material.

14. A sliding door hanger or guide as recited in claim 10 further comprising at least a second upstanding post on the body for opposing the foot of such an L-shaped limb.

15. A sliding door hanger or guide as recited in claim 10 wherein the means for connecting the body to the top of a door comprises a corner connector for interconnecting a door rail and a door stile, and including means for permitting vertical translation of the body relative to the corner connector.

16. A sliding door hanger or guide as recited in claim 15 comprising spring means on the body for biasing the body away from the corner connector and inhibiting rattling.

17. A sliding door hanger or guide for engaging a horizontal overhead track with a downwardly extending generally L-shaped limb comprising:

a body;

means for connecting the body to the top of such a door;

rigid means on the top of the body for encompassing both sides of at least the foot of such an L-shaped limb;

retainer means on the body for fitting over the top of the foot of the L-shaped limb for preventing the body from moving downwardly from the track; and means for moving the retainer means laterally from over the top of the foot for releasing the body from track.

18. A sliding door hanger or guide as recited in claim 17 wherein the retainer means comprises a hook on the end of a finger extending upwardly from the body for sliding along such a track.

19. A sliding door hanger or guide as recited in claim 18 wherein the finger can move sufficiently relative to the body for releasing the retainer means from the foot of the L-shaped limb.

20. A sliding door hanger or guide as recited in claim 18 wherein the finger is sufficiently elastically flexible for releasing the retainer means from the foot of the L-shaped limb.

21. A sliding door hanger or guide as recited in claim 20 wherein the body, rigid means, and flexible means are integral molded plastics material.

22. A sliding door hanger or guide for engaging a horizontal overhead track with a downwardly extending generally L-shaped limb comprising:

an integral plastics body;

means for connecting the body to the top of a door with at least a portion of the body extending over the top of the door;

a first pair of rigid posts extending upwardly from the portion of the body over the top of the door for opposing a face of such an L-shaped limb;

a second pair of upstanding posts on the body for opposing the foot of such an L-shaped limb in the space between the first posts and the second posts;

an elastically flexible finger extending upwardly from the body between the second pair of posts;

a hook at the top of the finger extending into the space between the first posts and second posts when the finger is in an unflexed position for extending over the top of the foot of such an L-shaped limb; and a tab on the finger extending laterally opposite the hook for manually flexing the finger and withdrawing the hook from over the top of the foot of such an L-shaped limb.

23. A sliding door hanger or guide as recited in claim 22 wherein the body comprises means for permitting relative vertical motion between the body and the means for connecting the body to the top of the door.

24. A sliding door hanger or guide as recited in claim 22 wherein the means for connecting the body to the top of a door comprises a corner connector for interconnecting a door rail and a door stile, and including means for permitting vertical translation of the body relative to the corner connector.

25. A sliding door hanger or guide as recited in claim 24 comprising spring means on the body for biasing the body away from the corner connector and inhibiting rattling.

26. A sliding door hanger or guide as recited in claim 12 further comprising at least a second upstanding post on the body for opposing the foot of such an L-shaped limb.

27. A sliding door hanger or guide as recited in claim 12 wherein the means for connecting the body to the top of a door comprises a corner connector for interconnecting a door rail and a door stile, and including means for permitting vertical translation of the body relative to the corner connector.

28. A sliding door hanger or guide as recited in claim 27 comprising spring means on the body for biasing the body away from the corner connector and inhibiting rattling.

29. A sliding door hanger or guide for engaging a horizontal overhead track with a downwardly extending generally L-shaped limb comprising:

a body;

means for connecting the body to the top of a door;

rigid means on top of the body for engaging such a track on at least the face opposite the foot of the L; and elastically flexible means for fitting over the top of the foot of the L-shaped track in an unflexed position nearer the rigid means and including a camming ramp for flexing the finger away from the rigid means and clearing the foot of the L-shaped track upon movement of the body upwardly onto the track.

30. A sliding door hanger or guide as recited in claim 29 wherein the elastically flexible means comprises a finger extending upwardly from the body and including a hook at its upper end for fitting over the foot of the track and sliding along the track.

31. A sliding door hanger or guide as recited in claim 29 comprising a tab protruding rearwardly from the finger opposite the hook for manually flexing the finger.

32. A sliding door hanger or guide for engaging a horizontal overhead track with a downwardly extending generally L-shaped limb comprising:

a body;

means for rigidly connecting the body to the top of a door;

at least one upstanding post on the body for opposing one face of such an L-shaped limb;

a finger extending upwardly from the body;

a hook at the top of the finger extending laterally toward such a post for engaging the foot of the L-shaped limb; and means on the finger for rotating the top of the finger away from the direction of extension of the hook upon vertically upward movement of the door for cleaning the limb of the track.

33. A sliding door hanger or guide as recited in claim 32 wherein the means for connecting the body to the top of a door comprises a corner connector for interconnecting a door rail and a door stile, and including means for permitting vertical translation of the body relative to the corner connector.

34. A sliding door hanger or guide as recited in claim 33 comprising spring means on the body for biasing the body away from the corner connector and inhibiting rattling.

35. A sliding door hanger or guide for engaging a horizontal overhead track with a downwardly extending generally L-shaped limb comprising:

a body;

means for rigidly connecting the body to the top of a door;

at least one upstanding post on the body for opposing one face of such an L-shaped limb;

a finger extending upwardly from the body;

a hook at the top of the finger extending laterally toward such a post for engaging the foot of the L-shaped limb for supporting the weight of the door; and means on the finger for rotating the top of the finger away from the direction of extension of the hook for disengaging the hook from such a limb.

36. A sliding door hanger or guide as recited in claim 35 wherein the means for rotating comprises a camming ramp on top of the finger for flexing the finger away from the rigid means and clearing the foot of the L-shaped track upon movement of the body upwardly onto the track.

37. A sliding door hanger or guide as recited in claim 35 wherein the means for rotating comprises a tab protruding rearwardly from the finger opposite the hook.

* * * * *